United States Patent [19]

Takano et al.

[11] 4,409,449

[45] Oct. 11, 1983

[54] OPERATING MECHANISM FOR USE IN A CIRCUIT BREAKER

[75] Inventors: Ikuo Takano, Hachioji; Hiroshi Umino, Inagi; Junji Fujiwara, Fuchuhonmachi, all of Japan

[73] Assignee: Tokyo Shibaura Denki Kabushiki Kaisha, Kawasaki, Japan

[21] Appl. No.: 386,395

[22] Filed: Jun. 8, 1982

Related U.S. Application Data

[63] Continuation-in-part of Ser. No. 94,297, Nov. 14, 1979, abandoned.

[30] Foreign Application Priority Data

Feb. 13, 1979 [JP] Japan ..... 54-14303

[51] Int. Cl.[3] ..... H01H 3/30

[52] U.S. Cl. ..... 200/153 SC; 335/76

[58] Field of Search ..... 200/153 SC; 335/76

[56] References Cited

U.S. PATENT DOCUMENTS

| | | | |
|---|---|---|---|
| 3,171,938 | 3/1965 | Pokorny | 200/153 SC |
| 3,689,721 | 9/1972 | McGuffie | 200/153 SC |
| 4,114,005 | 9/1978 | Maier et al. | 200/153 G |
| 4,152,561 | 5/1979 | Maier et al. | 200/153 G |
| 4,157,083 | 6/1979 | Smith et al. | 74/625 |

*Primary Examiner*—John W. Shepperd

*Attorney, Agent, or Firm*—Oblon, Fisher, Spivak, McClelland & Maier

[57] ABSTRACT

An operating mechanism for use in a circuit breaker having a stationary contact and a moving contact which is turned on (closed) or off (tripped open) by using the accumulated energy of a stretched spring, the operating mechanism having a frame, a main shaft having a closing cam and an additional cam, a four-joint crank for actuating the moving contact in accordance with the movement of the main cam, a roller clutch mounted around the shaft, a bearing fitting member having an opening mounted around the roller clutch, a gear member having a stud adapted to fit within the opening of the fitting member, and an electric motor and a manually operable handle to drive the spring to accumulate energy.

4 Claims, 12 Drawing Figures

OPERATING MECHANISM FOR USE IN A CIRCUIT BREAKER

BACKGROUND OF THE INVENTION

This is a continuation-in-part of application Ser. No. 094,297 filed Nov. 14, 1979, now abandoned.

FIELD OF THE INVENTION

This invention generally relates to a switch gear, and more particularly to a so-called "motor-stored energy" operating mechanism for use in a circuit breaker in which the operating mechanism is actuated by the accumulated energy in a biasing element, as for example, a spring, such energy being accumulated therein through the operation of an electric motor or a manually operable handle.

DESCRIPTION OF THE PRIOR ART

In the prior art, such motor-biasing operating mechanisms are used to close or trip a circuit breaker, especially air circuit breakers, by using such energy accumulated within a spring by the movement or operation of an electric motor associated therewith. Thus, after the energy for closing the circuit breaker is accumulated by the electric motor in the spring, the accumulated energy is discharged as a closing force, i.e., when the circuit breaker is closed.

It is, however, necessary to set the spring for accumulating more energy than is just required for closing the circuit breaker per se, because an amount of strain of the spring per se, i.e., the closing force, at the time that the force is required to close the circuit breaker, becomes small. Thus, not only must the spring operate under its accumulated energy to provide a force for moving a contact for closing the circuit breaker, but also to maintain such closure. Moreover, as a method of energizing of the spring, there has been employed a mechanism having a combination of a ratchet and a gear, but there is a problem with such devices in that a part of the ratchet and the gear is sometimes broken by virtue of the shock which occurs when the circuit breaker is forcefully closed, i.e., when the energy of the spring is discharged.

Furthermore, other problems also arise, such as, in the case such an operating mechanism is assembled within the circuit breaker, the mechanism becomes complicated and is weak against the mechanical shock or impact mentioned above, and the mechanism also becomes expensive to produce.

SUMMARY OF THE INVENTION

Accordingly, it is an object of this invention to provide a new and improved unique operating mechanism for use in a circuit breaker in which the operating mechanism is resistant against damage from mechanical shock and is simplified in construction, and also thereby economical as a whole to manufacture.

Another object of this invention is to provide a new and improved unique operating mechanism for use in a circuit breaker in which an over-loading to a mechanism for driving the biasing member is prevented from occurring.

Briefly, in accordance with one aspect of this invention, an operating mechanism for use in a circuit breaker is provided which includes a spring biasing element engaged with a main shaft, an electric motor and a manually operative handle operatively connected to the spring biasing element for causing the accumulation of energy therein and thus biasing the main shaft, a clutch being included in the connection of the motor, handle and main shaft, linkage between the main shaft and a movable contact of the circuit breaker for actuating the movable contact upon discharging the accumulated energy in the spring element, and a system for absorbing and thus preventing any over-loading to a mechanism for driving the spring.

BRIEF DESCRIPTION OF THE DRAWINGS

A more complete appreciation of the invention will be readily obtained as the same becomes better understood by reference to the following detailed description, when considered in connection with the accompanying drawings, wherein:

FIG. 5 shows the accumulating state;

FIG. 6 shows the closing state;

FIG. 7 shows the tripping state;

DETAILED DESCRIPTION OF A PREFERRED EMBODIMENT

Figure 1:
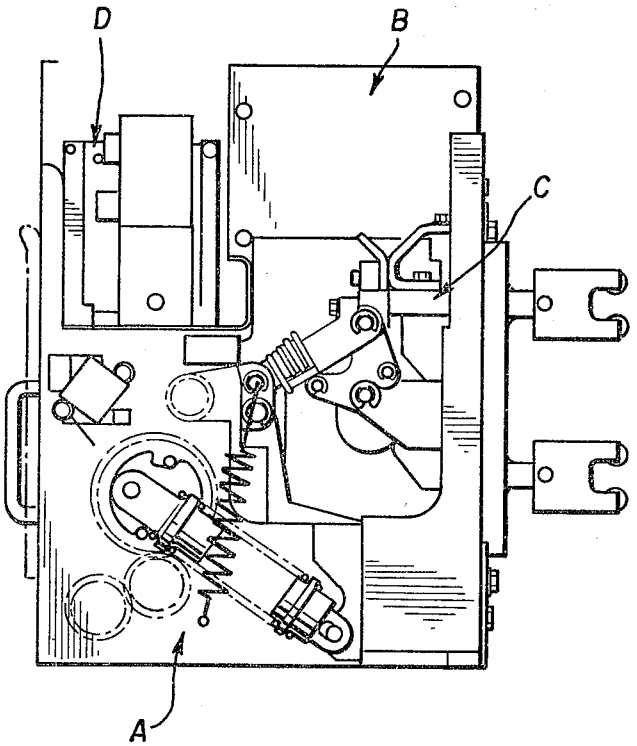
FIG. 1 is a side view of one embodiment of a circuit breaker formed according to this invention.

Referring now to the drawings, wherein like reference numerals and characters designate identical or corresponding parts throughout the several views, and more particularly to FIG. 1 thereof, wherein the perspective side view of one preferred embodiment of the operating mechanism A, in accordance with this invention, is shown, an arc extinguishing device B, a contactor C and a controlling device D are seen to be provided.

Figure 2:
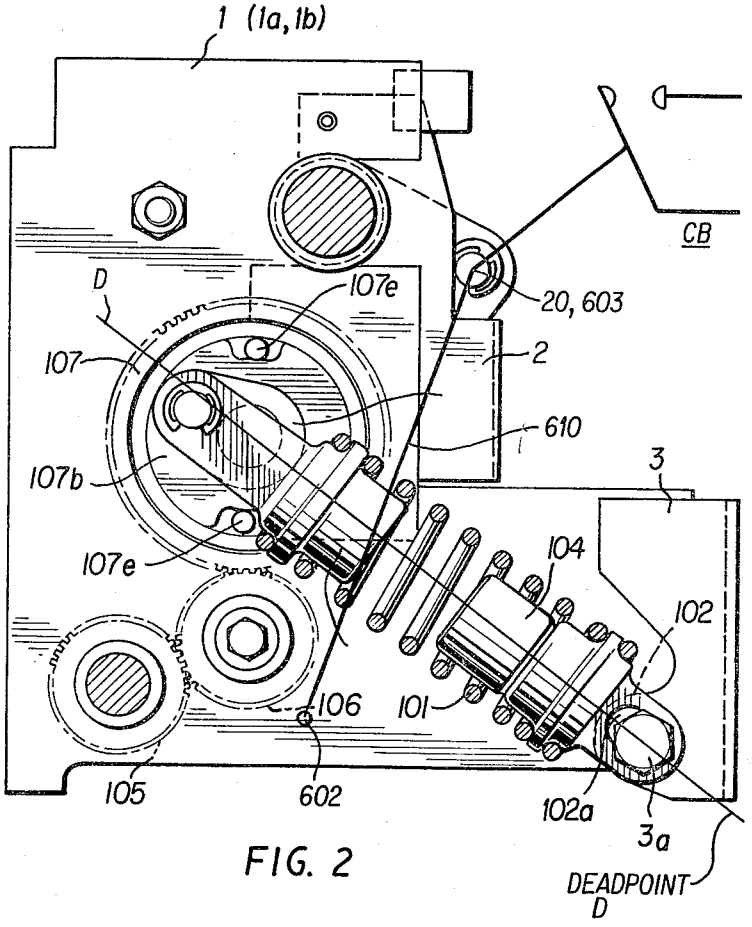
FIGS. 2 and 3 are side views indicating the different states or conditions of the spring biasing element of this invention.
Figure 4:
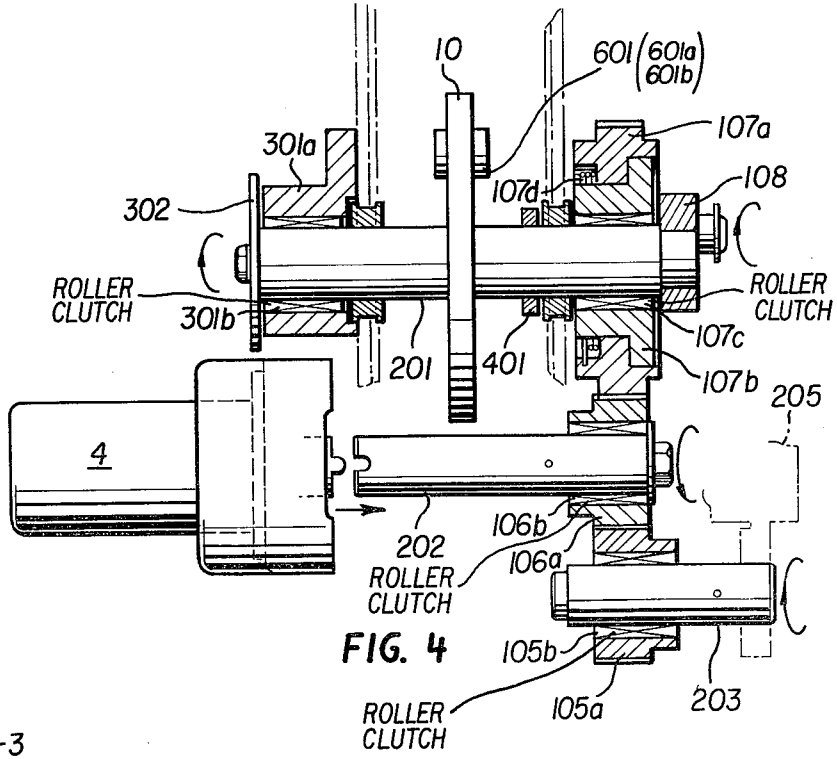
FIG. 4 is a front view of the operating mechanism formed according to this invention.
Figure 8:
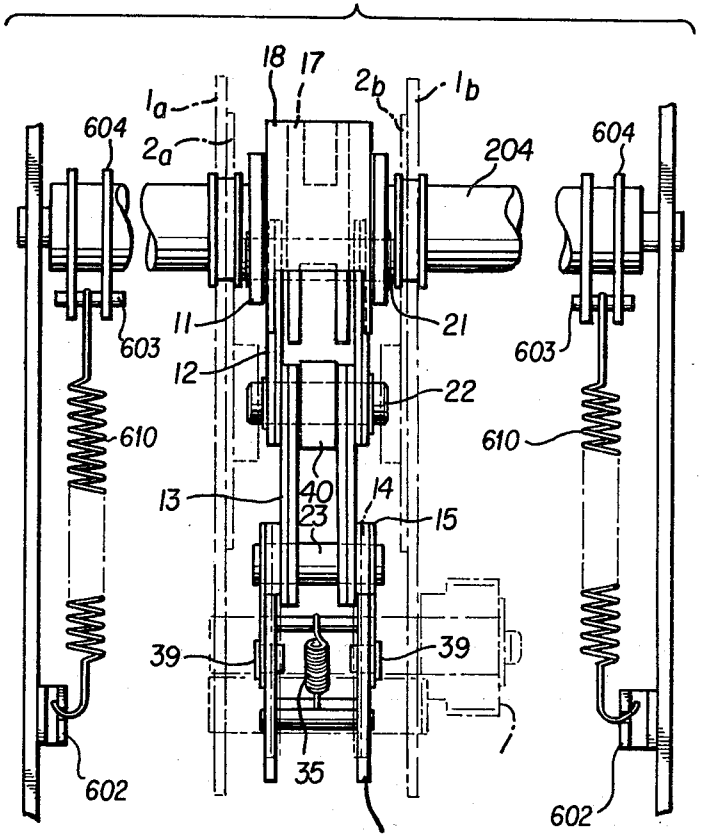
FIG. 8 is a front view of the link mechanism of the operating mechanism shown in FIGS. 5, 6 and 7.
Figure 9A:
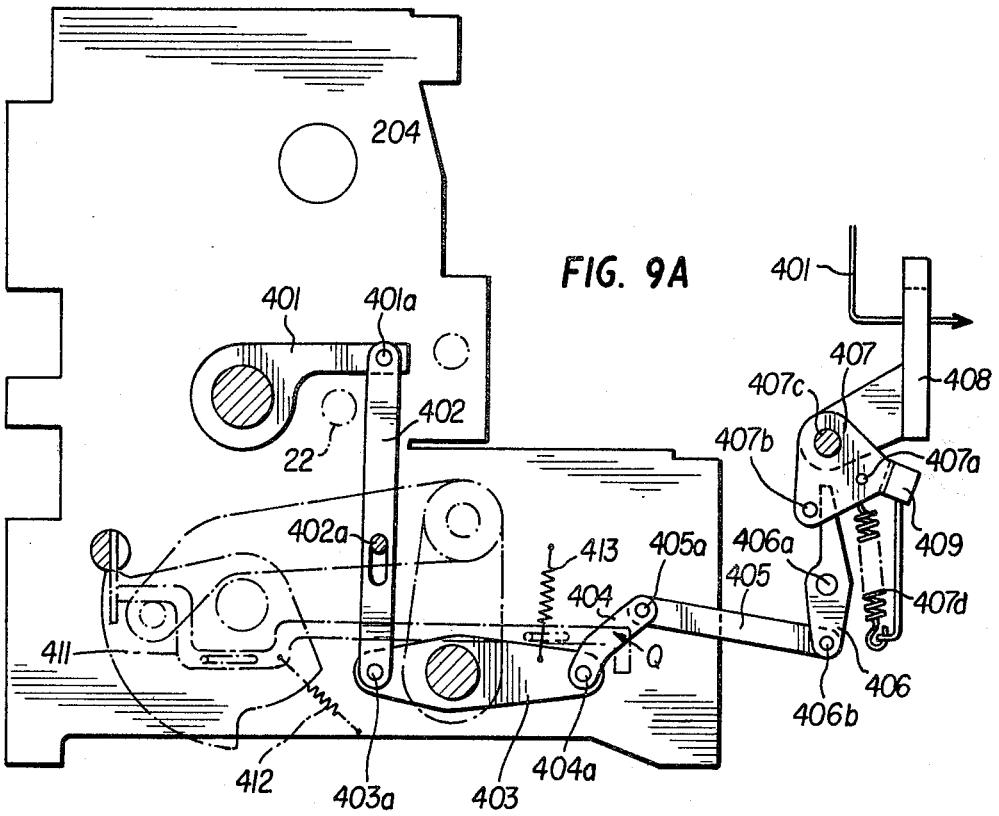
FIGS. 9A and 9B are side and top views, respectively, of a simultaneously operative tripping mechanism formed according to this invention; and FIGS. **10*a* and 10*b*** are front and side views, respectively, of an indicating mechanism formed according to this invention for indicating the state of the accumulating mechanism.
Figure 9B:
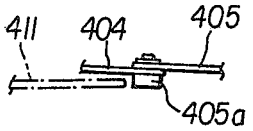

One preferred embodiment of this invention comprises an accumulating mechanism, as shown in FIGS. 2 and 4, a link mechanism for closing and tripping, as shown in FIGS. 5 through 8, a simultaneously operating tripping mechanism, as shown in FIGS. 9A and 9B, and an indicating mechanism for indicating the state of the accumulating mechanism, as shown in FIGS. **10*a* and 10*b***.

Figure 3:
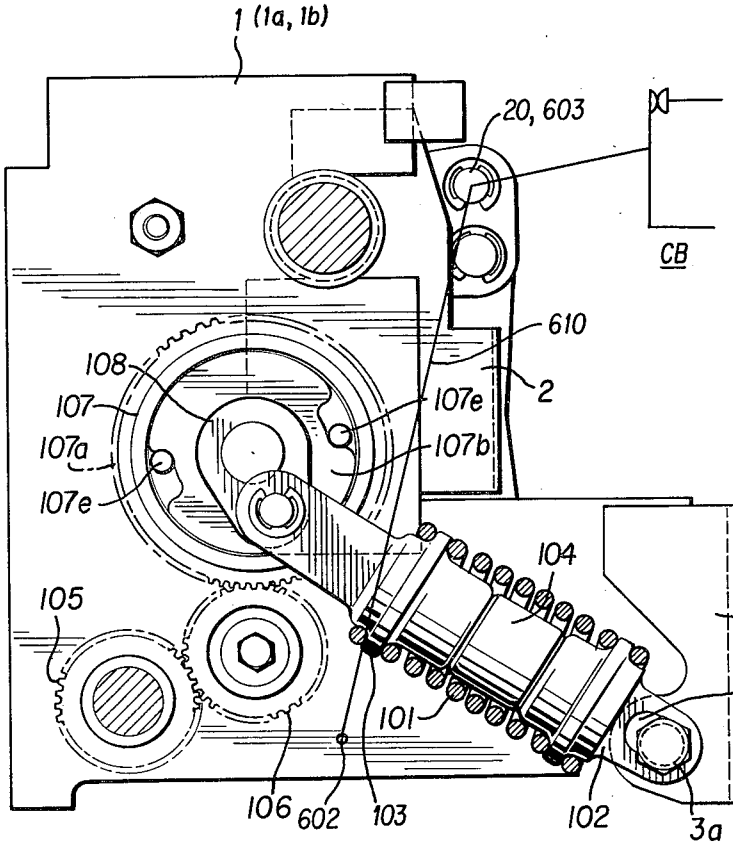

Referring now in particular to FIGS. 2 through 4, the arrangement of the parts of the accumulating mechanism is explained. A biasing element, for example, a closing spring 101, is provided between two fittings 102 and 103, with the fitting 102 having an elongated slot **102*a* therein and a stopper 104 provided at one end. The stopper 104 is disposed within the spring 101 so as to opposedly face the fitting 103 and thus serves to stop the movement of the fitting 103 in the direction of the fitting 102 when the circuit breaker is tripped. A manually operable accumulating gear device is generally indicated by the reference numeral 105 and comprises a gear 105***a* and a roller clutch 105*b* and is coupled with a motor driven accumulating gear device generally indicated by the reference numeral 106 and comprised of a gear 106*a* and a roller clutch 106*b*. The motor driven accumulating gear 106 is coupled with a main axle gear 107.

A frame 1, to which these mechanisms are attached, is in turn attached with a mounting frame 2 and an attaching frame 3 having a bolt 3*a* for being receivably engaged within the elongated slot 102*a* of the fitting 102. A connecting member 108, which is rotatably engaged with the end of the fitting 103 opposite the end facing the stopper 104 of the fitting 102, is mounted on the main axle gear assembly 107. Each of the roller clutches 105*b* and 106*b* is respectively press-fittingly fixed to its gear 105*a* and 106*a*.

The main axle gear 107 comprises a gear 107*a*, bearing fitting 107*b*, a roller clutch 107*c*, a spring 107*d* and a pin 107*e*, with the roller clutch 107*c* being mounted on the inner side of the bearing fitting 107*b*. The combination of the roller clutch 107*c* and the bearing fitting 107*b* is accommodated in the gear 107*a*. Although the relationship between the gear 107*a* and the bearing fitting 107*b* is that they are stretched in opposite rotational directions by the torsion spring 107*d*, two pins 107*e*, which are mounted on the gear 107*a* in positions corresponding to two openings in the bearing fittings 107*b*, limit the movement in such opposite directions at the positions in which the end portions of the openings in the bearing fitting 107*b* are contacted by the pins 107*e*. As shown in FIGS. 1, 2, 3, 5, 6, 7 and 8, springs 610 for operating on tripping are engaged between the outer frame enclosing the circuit breaker and a lever attached to a shaft (hereinafter described in detail in FIG. 8). In FIGS. 2, 3, 5, 6 and 7, the spring 601, engaged with stopping members 602 and pins 603, is shown by a dot and dash line.

In FIG. 4, a roller clutch 301*b* is press-fittingly fixed within bearing fitting 301*a* mounted on the frame 1. A main shaft 201 is coupled with the main axle gear 107. A motor shaft 202 adapted to engage with an electric motor 4 is coupled with the motor driven accumulating gear 106. The axle 203 of the manually operable handle 205 is coupled with the manually operable gear 105. An indicating cam 302, which indicates the state of the accumulation of energy of the spring 101, is mounted on the main shaft 201 by a screw. A closing cam 10 having a rotatable roller 601 is also mounted on the main shaft 201.

Referring now to FIGS. 5 through 8, the arrangement of the various elements of the mechanism of the link for closing and tripping is explained. The link mechanism is shown to be comprised of four joint links 11, 12, 13 and 14 being articulatingly joined respectively in end-to-end relation, a tripping link 15 engaged at one end to the pivotal juncture of links 13 and 14, a tripping catch 16 engaged to tripping link 15 at its other end by pin 39, a closing catch 17 being contacted along a curved surface thereof by a pin 30 mounted on the end of link 11 opposite the end of the link 11 being connected to link 12, an ON-OFF indicator 18, pins 21, 22 and 23 connecting the links 11, 12, 13 and 14, a tripping shaft 26, a closing shaft 27, a mounted pin 29, pins 31 and 32 on the tripping shaft 16 and the link 14 for securing the ends of a spring 35 thereto, a closing button 33 and a tripping button 34 and springs 37 and 38 respectively secured thereto, closing roller 49 carried by pin 22 between the joint links 12 and 13, and a closing catching roller 601*a* and a pin 601*b* thereof.

Thus, the first joint link 11, which is rotatably engaged with auxiliary shaft 204, is engaged with the second joint link 12 by the pin 21. The second joint link 12 is engaged with the third joint link 13 by the pin 22 on which is mounted the closing roller 40. The third joint link 13 is engaged at its one end with the fourth joint link 14 and with the tripping link 15 by the pin 23, with the link 15 being engaged at its other end with the tripping catch 16 by the pin 39. The closing catch 17 is biased by a spring 36 in the opposite direction of movement of the ON-OFF indicator 18 through a connecting pin 29.

Figure 6:
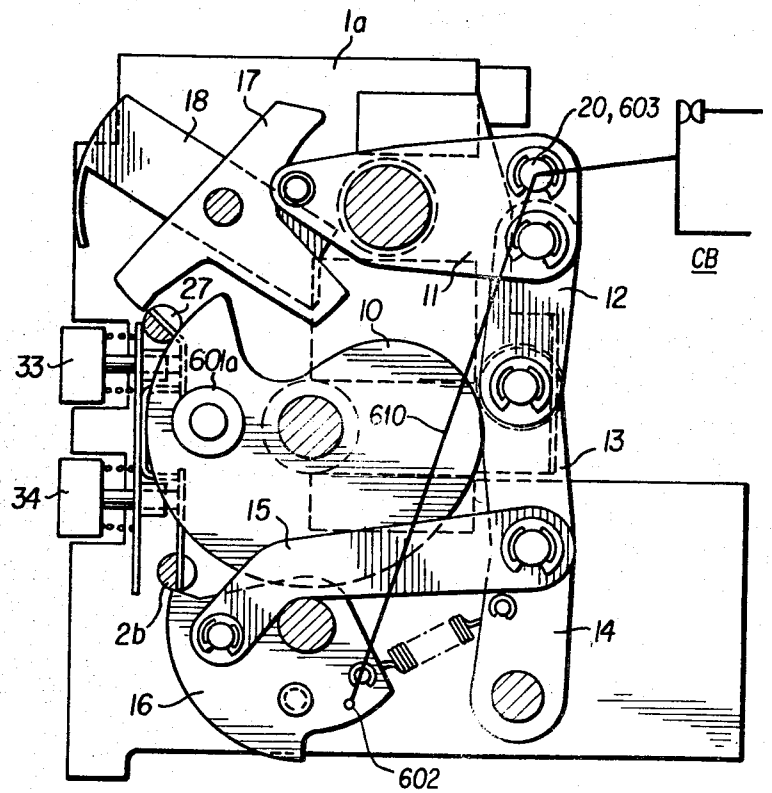
FIGS. 5, 6 and 7 are side views indicating the different states or operative positions of a link mechanism for closing and tripping the circuit breaker formed according to this invention.
Figure 5:
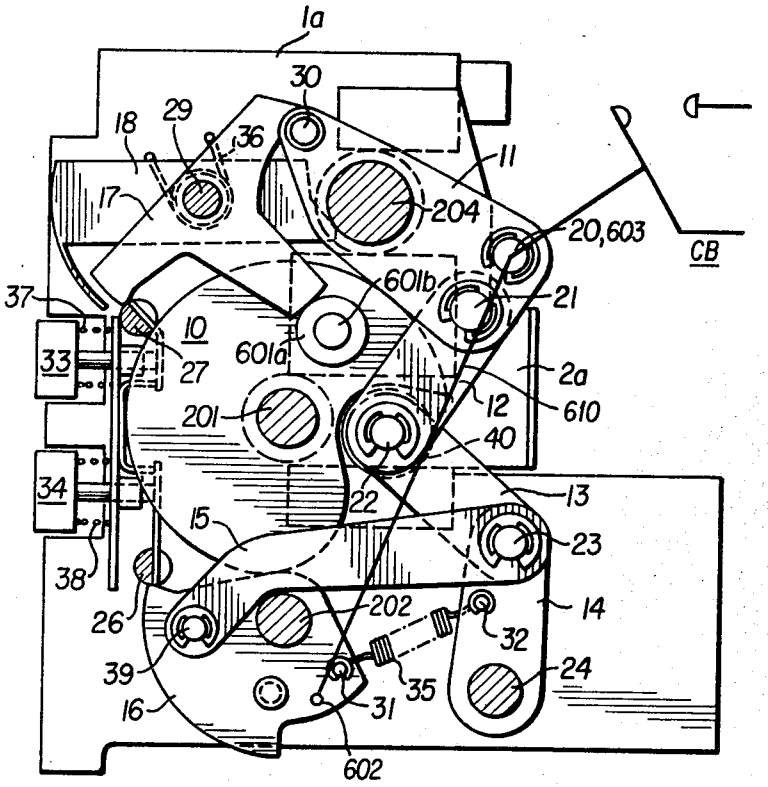
Figure 7:
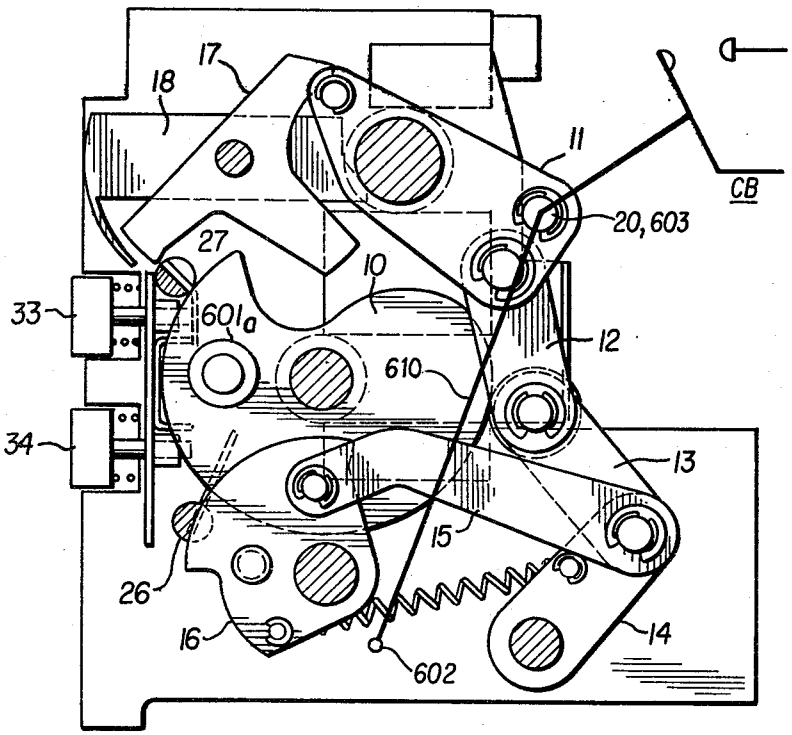

Spring 35 is stretched between the pin 31 of the tripping catch 16 and the pin 32 of the fourth joint link 14, and serves to return the fourth joint link 14 to the condition shown in FIGS. 5 and 6, from that shown in FIG. 7.

The pin 30, which is mounted on the one end of the first joint link 11 opposite the end connected with link 12, is used to stop the movement of the closing catch 17 and to operate the ON-OFF indicator 18. Pin 20 at the other end of the first joint link 11, adjacent pin 21, is connected with an operating rod (not shown) for actuating the contactor of the circuit breaker. The tripping and closing shafts 26 and 27, which stop respective tripping and closing catches 16 and 17, as shown, are formed of semi-circular configuration. On auxiliary shaft 204, levers 604 with pins 603 are, as shown in FIG. 8, fixed at a position between frames 1*a* and 1*b* and outer frames and an angle same as that of link 11, respectively. The springs 610, for operating the link mechanism for tripping the moving contact of circuit breaker CB, are engaged between stopping members 602 attached to the outer frame and pins 603 of lever 604.

Referring not to FIGS. 9A and 9B, a simultaneously operating tripping mechanism, which operates only when the circuit breaker is closed, comprises articulated links 401, 402, 403, 404 and 405 joined by pins 401*a*, 403*a*, 404*a* and 405*a*, a linkage element 411 associated therewith and operably moved by pin 405*a*, an insulated paddle 406 pivotally mounted on pin 406*a* and joined at one end to link 405 by pin 406*b*, a magnet link 407 having pins 407*a* and 407*b* thereon and pivotally mounted on pin 407*c*, a stationary magnet 408, a moving magnet 409 mounted on the magnet link 407, a main current line 410, a spring 407*d* associated with the magnet link 407, and springs 412 and 413 associated respectively with links 411 and 403 for returning such to base positions.

The link 401 is engaged with the link 402 by the pin 401*a*, link 402 is in turn engaged with link 403 by the pin 403*a*, link 403 is engaged with the link 404 by the pin 404*a*, the link 404 is engaged with the link 405 by the pin 405*a*, and the link 405 is engaged with the insulating paddle 406 by the pin 406*b*.

The magnet link 407 is energized in the clockwise direction of movement by the stretched spring 407*d* which is engaged with the pin 407*a* of the magnet link 407.

Figure 10B:
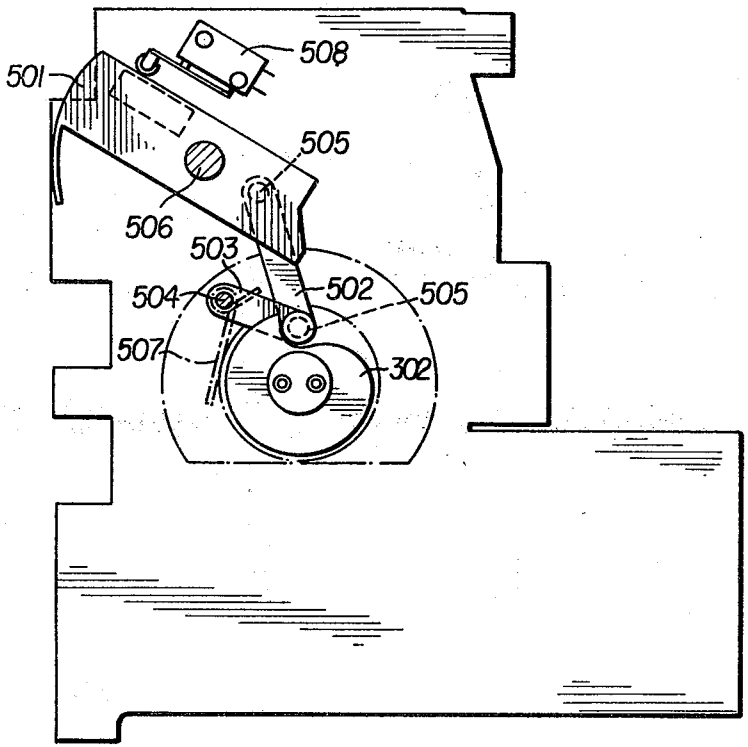
Figure 10A:
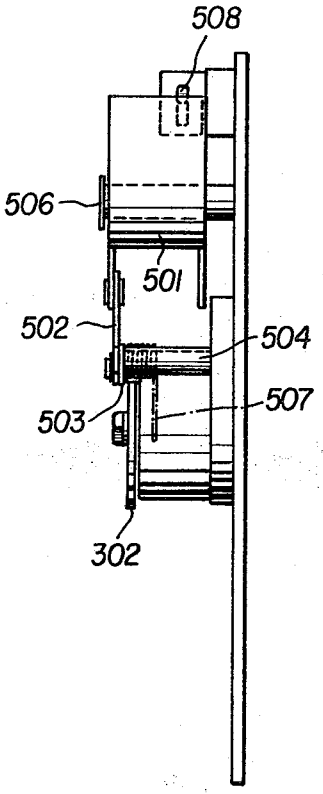

Referring now to FIGS. 10*a* and 10*b*, the indicating mechanism for indicating the state of the accumulating mechanism comprises an indicating panel 501 rotatably mounted on pin 506, links 502 and 503, a mounted pin 504, pins 505 and 509, a spring 507 and a micro switch 508. The indicating panel 501 is engaged with the link 502 by the pin 509, and the link 502 is in turn engaged with the link 503 by the pin 505. The spring 507, which is mounted on the mounted pin 504, is mounted so as to press the pin 505 against the indicating cam 302. The micro switch 508 is mounted to provide the ON-OFF signal corresponding to the state of the accumulating spring. It should now be understood that the roller clutches mentioned above have the following merits. That is, rotation in one direction is free against the shaft and the bearing case, as well as identical to the friction coefficient of the bearing, and in the other direction, rotation is locked. Although the roller clutch has a function identical to a ratchet mechanism, the roller clutch is compact, light and its operating position is on a vernier scale compared with that of the ratchet mechanism.

The operation of this invention is now explained. FIG. 2 shows the state in which energy is stored or accumulated in the stretched spring 101, while FIG. 3 shows the state in which the stored energy has been discharged or released from the stretched spring 101. The accumulating operation is carried out by the driving means, for example, the electric motor 4 or manually operable handle 205.

In FIG. 4, the arrows indicate the locked direction of rotation of each bearing case relative to each shaft, i.e., when the bearing case is rotated in the direction of the arrow, the roller clutch is locked. Therefore, the shaft is freely rotated in the direction of the arrow, and the bearing case is freely rotated in the opposite direction from that indicated by the arrow.

When the spring 101 is to be stretched from its discharged state, shown in FIG. 3, to the charged state, shown in FIG. 2, by the manually operable handle 205, the handle 205 is pulled from the position shown in FIG. 4 in the direction of the viewer, or outward from the paper, and the handle shaft 203 is accordingly rotated in the counterclockwise direction, as seen from the right. At this time, since the handle shaft 203 is locked with the roller clutch **105*b*, the gear 105*a* is also rotated counterclockwise. By the rotation of the gear 105*a*, the gear 106*a* engaged therewith is rotated clockwise. Because, in this instance, the motor shaft 202 is freely rotatable, only the gear 106*a* is rotated. By the rotation of the gear 106*a*, the gear 107*a* is rotated counterclockwise until the pin 107*e* on the gear 107*a* contacts with the end of the opening in the bearing fittings 107*b*, and the bearing fitting 107*b* is then rotated in accordance with the rotation of the handle 205. The rotation of the bearing fitting 107*b* is then transferred to the main shaft 201 through the roller clutch 107*c***.

When the handle 205 is returned, since the handle shaft 203 is freely rotated with the roller clutch **105*b*, the gear 105*a* does not rotate. At this time, although the closing spring is energized a little and the main shaft 201 is intended to be rotated clockwise by the connecting member 108 engaged on the shaft 201, the main shaft 201 is locked by the roller clutch 301*b* mounted on the frame 1. By repeating the operation of the handle 205 a few times, the closing spring 101 reaches the dead point D, shown in FIG. 2. When the moving end of the closing spring 101 exceeds the dead point D, the main shaft 201 has the rotating force, for counterclockwise rotation by the closing spring 101. At this time, although the main shaft 201 is freely rotatable through the roller clutch 107*c*, the main shaft 201 is stopped because the roller 601 mounted on the closing cam 10 coupled with the main shaft 201 is engaged with the closing catch 17, as shown in FIG. 5. This position shows the state in which complete accumulation of energy has been achieved in the closing spring 101**.

When the closing spring 101 exceeds the dead point D and the main shaft 201 is rotated counterclockwise, the bearing fitting **107*b* is slightly rotated counterclockwise by the effect of the spring 107*d* provided between the bearing fitting 107*b* and the gear 107*a*, and a gap is generated between the opening of the bearing fitting 107*b*and the pin 107*e*, as shown in FIG. 2. The gap is an effective means for preventing the over-loading occurring when accumulation of the closing spring is completed, particularly in case of the accumulation by operation of the electric motor 4. In other words, the over portion (or component) of the driving rotating force for accumulating the energy is absorbed by the gap generated between the opening of bearing fitting 107*b* and pin 107*e***

When the closing spring 101 exceeds the dead point D, the electric motor 4 is de-energized. However, the electric motor 4 generally has inertia movement so that the over-portion of the gear **107*a* having pin 107*e* is generated. When the end of connecting member 108 exceeds the dead point D, the bearing fitting 107*b* is rotated by virtue of the righting moment of spring 107*d* until the roller 601*a* mounted on the cam 10 associated with the bearing fitting 107*b* via the main shaft 201 is stopped by closing catch 17 (FIG. 5**).

Then gear **107*a* having pin 107*e* is rotated by inertia movement of motor 4 overcoming the force of spring 107*d*. Namely, pin 107*e* is rotated counterclockwise a few turns, but the over-loading from inertia movement does not apply to catch 17 and parts associated therewith via the main shaft 201. It should be readily apparent that in case of the accumulation of energy is spring 101 by the electric motor 4, the gear 105*b* is only run idle and the handle shaft 203** does not rotate.

The operation of the closing spring now is explained. The closing spring 101 acts when the closing spring 101 is transferred from the state of accumulation shown in FIG. 2 to the state of discharge shown in FIG. 3. At this time, by bringing the fitting 103 and the stopper 104 mounted on the fitting 102 together, the energy of the closing per se is lost before the position of the dead point D. However, when the closing spring 101 is transferred from the state of accumulation shown in FIG. 2 to the state of discharge shown in FIG. 3, the energy of the closing spring 101 is also given to rotate the main shaft 201 and the closing cam 10, and by this energy, the closing of the circuit breaker is carried out through the four joint links 11, 12, 13 and 14. Usually, the closing energy for the circuit breaker is designed to have 120–130 percent of the minimum energy for closing on no-load, including closing and margin, when the circuit current flows. Accordingly, even though the stopper 104 is provided with the closing spring 101, and the stopper 104 is struck against the fitting 103, the rotating energy of the main shaft 201 is not totally used in the general closing operation. If the closing spring 101 is stopped by the stopper 104, the movement of the closing spring 101 exceeds the position of the dead point D, and the rotating energy of the main shaft 201 is energized as the accumulation of the closing spring 101 and also gives to the roller clutch **301*b* a margin of energy for shock. Even though the closing spring 101 is stopped by the stopper 104 before the position of the dead point D, if the elongated slot 102 mounted on the fitting 102 did not exist, the main shaft 201 would have to suddenly stop. Consequently, the shock by suddenly stopping is given to the roller clutch 301***b*, the connecting member 108 and the bolt 3*a*. Thus, by providing the stopper 104 with the closing spring 101 and providing the elongated hole 102*a* with the closing spring, the rotating energy of the main shaft 201 is mainly absorbed by the stopper 104 and the elongated hole 102*a*, and it is possible to prevent the shock against the connecting member 108, bolt 3*a* and the roller clutch 301*b*. Accordingly, in accordance with this invention, the marginal rotating energy is attenuated by the elongaged hole 102*a*.

Referring now to FIGS. 5 through 8, the operation of the link mechanism for closing and tripping the circuit breaker is explained. FIG. 5 shows the OFF state of the circuit breaker and the position of the accumulated energy state of the closing spring 101. FIG. 6 shows the ON state of the circuit breaker and the state when the accumulated energy in the closing spring 101 is discharged by pushing the closing button 33. FIG. 7 shows the OFF state of the circuit breaker and the state when the closing operation is completed. FIG. 8 illustrates the relationship between each link and pin and is a front view of the link mechanism as shown in FIGS. 5 through 7. The feature of this link mechanism is to simplify by providing the closing roller 40 with the pin 22 provided between the second joint link 12 and the third joint link 13 of the four joint links 11, 12, 13, and 14, and by actuating the roller 40 through the closing cam 10 mounted on the main shaft 201.

The closing cam 10 especially is formed as a concentric circle centering on the main shaft 201, except for the portion utilized during the time in which the circuit breaker is closed as shown in FIG. 6 and serves to support the four joint link mechanism from after the completion of the closing of the accumulation. When the circuit breaker CB is closed as shown in state from FIG. 5 to FIG. 6, link 11 associated with lever 604 via auxiliary shaft 204 is clockwise in FIG. 6 biased.

The tripping is carried out by the tripping button 34. When the button 34 is pushed, causing clockwise rotation of the shaft 26, as seen in FIG. 5, the tripping catch 16 is rotated clockwise, as shown in FIG. 7 since the corner of the tripping catch 16 is disengaged from the shaft 26. In the closed state as shown by FIG. 6, the force of the spring 610 for opening the moving contact of circuit breaker CB continues to work so as to cause the joint link 11 to be biased in a clockwise direction with shaft 204 as an axis of rotation. When catch 16 is released, the force of stretched spring 610 causes the four joint links 11, 12, 13 and 14 to deform as shown for example in FIG. 7, overcoming the force of spring 35. As can be seen from FIGS. 6 and 7, cam 10 remains in the same position in both figures. The spring 35 connected between the pin 32 on the fourth joint link 14 and the pin 31 on the tripping catch 16 returns the four joint link mechanism 11, 12, 13 and 14, together with the tripping catch 16, after the tripping operation. In the accumulating state of the closing spring 101, the main shaft 201 is held in engagement between the closing catch 17 and the roller 601*a* mounted on the cam 10. Since the closing catch 17 is biased in the counterclockwise direction about the mounted pin 19 as a fulcrum, when the closing button 33 is pushed, the closing shaft 27 is rotated counterclockwise and, after disengaging the closing catch 17 with the roller 601*a*, the closing cam 10 is rotated counterclockwise by the energy of the closing spring 101. At that time, as shown in FIG. 6, the movement of the closing catch 17 is restricted by the pin 30 mounted on the first joint link 11. Moreover, to simplify the assembly of the link mechanism, after the four joint links 11, 12, 13 and 14, the tripping link 15 and the tripping catch 16, adapted to be attached to the main shaft 201, are assembled, its mechanism is attached to the main shaft 201. Moreover after the main shaft gear 107, the closing cam 10 and the connecting member 108 are assembled, its assembly is inserted within the openings 1*a* and 1*b* of the frame 1 and is fixed by the holding frame 2. The end of the holding frame 2 serves to prevent the turning over of the second joint link 12 and the third join link 13 when the circuit breaker is closed because the end of the holding frame 2 then contacts with the pin 22 as shown in FIG. 6.

Referring now to FIGS. 9A and 9B, the operation of the simultaneously operating tripping mechanism, which operates only when the circuit breaker is closed as shown in FIG. 6, is explained. When an excessive current flows in the main circuit, upon closing the circuit breaker, this simultaneously operating tripping mechanism serves to immediately trip the circuit breaker. Accordingly, after the completion of the closing of the circuit breaker, the mechanism does not allow an excess current to flow.

If the current, which exceeds the current determined by the spring 407*d*, flows through the circuit breaker, the magnets 408 and 409 are energized by the load current in the line 410 and the magnet link 407 is thus rotated counterclockwise to contact the magnets 408 and 409. At this time the pin 407*b* rotates the insulating paddle 406 clockwise about the mounted pin 406*a* as a fulcrum. Consequently, the link 405 is moved a certain distance in the leftward direction as viewed in FIG. 9A. In addition, the link 405 is moved by the link 404 to either the P point or Q point shown in FIG. 9A. The link 404 is connected with the link 401 through the links 402 and 403. Since the link 401 is mounted on the contacting point with the end of the pin 22, shown in FIGS. 5 through 8, when the R point of FIG. 9A is moved in the direction of the arrow, the link 401 is pushed up. The position (pushed up) of the connection pin 405*a* provided between the link 404 and the link 405 is the Q point. When the circuit breaker achieves the state of the accumulation, the link 401 is returned by the force of the spring 413 to the original position. Furthermore, the circuit breaker in general has an arcing contact and a main contact when the circuit breaker is closed, and the main contact is contacted with a certain delay time. Thus, the link 401 is pushed up at the time the arcing contact is contacted. Consequently, if the position of the connection pin 405*a* is positioned at the Q point, when the magnet link 407 is moved in the rightward direction, the link 411 is moved in the leftward direction so as to trip. The feature of this simultaneously operating tripping is to select the setting position according to the relationship between the link 401 and the pin 22.

Referring now to FIGS. 10*a* and 10*b*, the indicating mechanism for indicating the state of the accumulating mechanism is explained. The indicating cam 302, which is mounted on the main shaft 201 by a screw, is positioned as shown in FIG. 10*b*, at the state of the completion of the accumulation. At this time, since the pin 505 is positioned at the deeper portion of the groove of the indicating cam 302 by the force of the spring 507, the indicating panel indicates the accumulation of the closing spring 101 and the micro switch 508 is operated. On the other hand, when the pin 505 is positioned as a position outside the deepest groove portion, the indicating panel 501 indicates the discharging state of the circuit breaker, etc. It should now be apparent that, in accordance with the teachings of this invention, it is possible to simplify the structure of the operating mechanism. Moreover, it is possible to prevent over-loading occurring when the accumulation of closing spring 101 is completed through the combination of the openings in the bearing fittings 107*b* and the pins or studs 107*e* of the gear member 107*a*. Consequently, since the over force from the driving rotating motor is absorbed by the spring 107*d* mounted between the bearing fittings member and the gear member, the application of the over force to the main shaft 201 is prevented. Furthermore, since the accumulating mechanism has the fitting member 102 having the elongated slot 102*a* to be attached on the frame, and the stopper 104, it is possible to absorb the mechanical shock when the circuit breaker is tripped.

Obviously, many modifications and variations of the present invention are possible in light of the above teachings. It is therefore to be understood that within the scope of the appended claims, the invention may be practiced otherwise than as specifically described herein.

What is claimed as new and is intended to be secured by Letters Patent is:

1. An operating mechanism for use in a circuit breaker having a stationary contact and a moving contact, said mechanism comprising:

a frame;

a shaft disposed on said frame;

link means for actuating said moving contact of the circuit breaker;

accumulating means for accumulating energy for actuating said moving contact and provided between said frame and said shaft;

means for associating said link means with said accumulating means;

means fo driving said accumulating means;

at least one roller clutching means provided between said means for driving said accumulating means and said accumulating means;

biasing means for biasing said link means;

means for operating said link means for closing said moving contact of the circuit breaker by using the accumulated energy of said accumulating means;

means for operating said link means for tripping said moving contact of the circuit breaker by using the energy of said biasing means; and means for absorbing an an over-loading of said means for driving said accumulating means and provided between said accumulating means and said means for driving said accumulating means wherein said means for absorbing an over-loading as said means for driving said accumulating means comprises:

a connecting element mounted on said shaft and connected with one end of said accumulating means;

a bearing fitting member mounted circumferentially around a first roller clutching means and having at least one predetermined gap, wherein said first roller clutching means is mounted on said shaft; and a gear member mounted around said fitting member having at least one stud adapted to fit within said gap of said fitting member, wherein said at least one gap and stud permit relative movement between said bearing fitting member and said gear member, said movement being limited by said predetermined gap.

2. An operating mechanism according to claim 1 which further comprises:

a spring mounted between said bearing fitting member and said gear member for biasing said fitting member and said gear member in opposite rotational directions.

3. An operating mechanism according to claim 1, further comprising:

first and second spring fitting members attached at opposite ends of said accumulating means;

a pin mounted on said frame; and a first of said fitting members having a longated slot in which said pin is slidably received.

4. An operating mechanism according to claim 3, further comprising a stopper member between said first and second spring fitting members of said means for accumulating energy.

* * * * *